US007410320B2

(12) United States Patent
Faller et al.

(10) Patent No.: US 7,410,320 B2
(45) **Date of Patent: *Aug. 12, 2008**

(54) HIGH-IMPACT, ENERGY-ABSORBING VEHICLE BARRIER SYSTEM

(75) Inventors: Ronald K. Faller, Lincoln, NE (US); Dean L. Sicking, Lincoln, NE (US); John R. Rohde, Lincoln, NE (US); John D. Reid, Lincoln, NE (US); Robert W. Bielenberg, Lincoln, NE (US); James C. Holloway, Lincoln, NE (US); Karla A. Polivka, Lincoln, NE (US)

(73) Assignee: Board of Regents of University of Nebraska, Lincoln, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/216,324

(22) Filed: Aug. 31, 2005

(65) Prior Publication Data

US 2006/0045617 A1 Mar. 2, 2006

Related U.S. Application Data

(60) Provisional application No. 60/605,775, filed on Aug. 31, 2004.

(51) Int. Cl.
*E01F 15/00* (2006.01)

(52) U.S. Cl. ..... 404/6

(58) Field of Classification Search ..... 404/6, 404/10; 256/13.1
See application file for complete search history.

(56) References Cited

U.S. PATENT DOCUMENTS 3,049,062 A 8/1962 Irwin
3,666,055 A 5/1972 Walker et al.
3,674,115 A 7/1972 Young et al.
3,680,662 A 8/1972 Walker et al.
3,944,187 A 3/1976 Walker (Continued)

FOREIGN PATENT DOCUMENTS

DE 200 03 791 U 1 6/2000

OTHER PUBLICATIONS

Reid, John D., et al., "High Speed Crash Barrier Investigation Using Simulation", AMD-vol. 246/BED-vol. 49, Crashworthiness, Occupant Protection and Biomechanics in Transportation Systems-2000, ASME 2000.

(Continued)

*Primary Examiner*—Gary S. Hartmann
(74) *Attorney, Agent, or Firm*—Shook, Hardy & Bacon L.L.P.

(57) ABSTRACT

A high-impact, energy-absorbing vehicle barrier system generally includes a substantially rigid outer containment wall coupled via strap assemblies with an energy-absorbing inner impact wall, and energy-absorbing cartridges strategically positioned between the impact wall and containment wall. The impact wall is constructed of a number of tubes coupled with one another to present a substantially smooth, uniform surface to passing vehicles. The energy-absorbing cartridges generally consist of a foam member or a number of foam sheets which compress and crush between the containment wall and impact wall to absorb energy from an errant vehicle striking the face of the impact wall, while the deflection and deformation of the impact wall tubes dissipates additional energy to reduce peak decelerations and mitigate the severity of high-energy vehicular impacts. Internal splice units and the strap assemblies provide for relatively easy and quick replacement of damaged impact wall sections and energy-absorbing cartridges.

21 Claims, 8 Drawing Sheets

U.S. PATENT DOCUMENTS

| | | | | |
|---|---|---|---|---|
| 4,101,115 | A | 7/1978 | Meinzer | |
| 4,321,989 | A | 3/1982 | Meinzer | |
| 4,452,431 | A | 6/1984 | Stephens et al. | |
| 4,674,911 | A | 6/1987 | Gertz | |
| 4,681,302 | A | 7/1987 | Thompson | |
| 4,773,629 | A | 9/1988 | Yodock | |
| 4,815,565 | A | 3/1989 | Sicking et al. | |
| 4,869,617 | A | 9/1989 | Chiodo | |
| 4,946,306 | A | 8/1990 | Yodock | |
| 5,125,762 | A | 6/1992 | Strassil | |
| 5,238,228 | A | 8/1993 | Moon | |
| 5,314,261 | A | 5/1994 | Stephens | |
| 5,403,112 | A | 4/1995 | Carney, III | |
| 5,425,594 | A | 6/1995 | Krage et al. | |
| 5,605,413 | A | 2/1997 | Brown | |
| 5,645,368 | A | 7/1997 | Yunick | |
| 5,660,496 | A | 8/1997 | Muller et al. | |
| 5,797,592 | A | 8/1998 | Machado | |
| 5,823,584 | A | 10/1998 | Carney, III | |
| 5,851,005 | A | 12/1998 | Muller et al. | |
| 5,860,762 | A | 1/1999 | Nelson | |
| 5,882,140 | A | 3/1999 | Yodock, Jr. et al. | |
| 5,915,876 | A | 6/1999 | Barbazza | |
| 5,921,702 | A | 7/1999 | Fitch | |
| 5,947,452 | A | 9/1999 | Albritton | |
| 6,004,066 | A | 12/1999 | Niemerski | |
| 6,007,269 | A | 12/1999 | Marinelli | |
| 6,010,275 | A | 1/2000 | Fitch | |
| 6,024,341 | A | 2/2000 | Gertz | |
| 6,048,138 | A | 4/2000 | Lamberson et al. | |
| 6,082,926 | A | 7/2000 | Zimmer | |
| 6,149,134 | A | 11/2000 | Bank et al. | |
| 6,488,268 | B1 | 12/2002 | Albritton | |
| 6,530,560 | B2 | 3/2003 | King | |
| 6,536,986 | B1 | 3/2003 | Anghileri et al. | |
| 6,540,434 | B1 | 4/2003 | Hotchkin | |
| 6,551,010 | B1 | 4/2003 | Kiedaisch et al. | |
| 6,554,530 | B2 | 4/2003 | Moore | |
| 6,604,888 | B2 | 8/2003 | Dolan | |
| 6,702,513 | B1 * | 3/2004 | Raupach | 404/6 |
| 6,926,461 | B1 * | 8/2005 | Faller et al. | 404/6 |
| 2003/0081997 | A1 | 5/2003 | Kramer | |

OTHER PUBLICATIONS

Giavotto, V., et al. "Vehicle Dynamics and Crash Dynamic with Minicomputer", Program Development & Technical Appliance Ltd. SPAT, Alberata 401, Milano 2 SEGRATE, Italy and Institute for Road Safety Research SWOV, Duindorn 32, Leidshendam, The Nederlands, Computer Structures, vol. 16, No. 1-4, pp. 381-393, 1983.

Fitch, John D., et al. "Impact Attenuation Devices for Racing", Impact Dynamics, L.L.C., and Safety Quest, Inc., Society of Automotive Engineers, Inc., pp. 199-209, 1998.

Reid, John D., et al. "High Speed Crash Barrier Investigation Using Simulation" AMD-vol. 246/BED-vol. 49, Crashworthiness, Occupant Protection, and Biomechanics in Transportation Systems, ASME 200.

* cited by examiner

HIGH-IMPACT, ENERGY-ABSORBING VEHICLE BARRIER SYSTEM

CROSS-REFERENCE WITH RELATED APPLICATIONS

This application claims the benefit of U.S. Provisional Application No. 60/605,775, filed on Aug. 31, 2004, which is incorporated herein by reference.

STATEMENT REGARDING FEDERALLY SPONSORED RESEARCH OR DEVELOPMENT

Not applicable.

BACKGROUND OF THE INVENTION

In recent years, automobile racing has become one of the most popular sporting events in the United States and abroad. Auto racing's popularity is evidenced by the number of weekend auto races, extensive fan support and corporate sponsorship, and 24-hour cable television coverage. In addition, the sport's popularity is seen in the wide variety of race series available for drivers and spectators, including the Indy Racing League (IRL), NASCAR's car and truck series, FORMULA 1, CART, and IROC.

In automobile racing, high-performance vehicles travel many times around an oval track at very high speeds. Many of these tracks utilize outer retaining or containment walls, typically in the form of substantially rigid concrete barriers, to prevent race vehicles from leaving the track. Unfortunately, race vehicles frequently lose control and impact the rigid outer containment wall, resulting in high-impact energies and, occasionally, driver injuries and fatalities. Errant vehicles and driver injuries and fatalities do not occur only on race tracks, but on highways, interstates, autobahns, and other public roadways in the United States and abroad. An improved barrier system can mitigate the severity of high-speed, high-energy automobile accidents and potentially reduce the number of injuries and fatalities on race tracks and public roadways.

Over the years, there have been many efforts to advance the state of the art of safety barrier design and construction. Some of the simpler proposed solutions consisted of loosely-stacked foam blocks placed around the outer, exterior walls of the track or roadway to reduce the severity of impact between the errant vehicle and the rigid wall. An impacting vehicle, however, can penetrate these foam blocks and strike the retaining wall with little or no impact energy having been absorbed by the blocks. Further, portions of the foam blocks can be knocked onto the track or roadway by the impacting vehicle, creating a hazard for other vehicles that follow. Other barrier designs have incorporated used rubber automobile tires banded together at selected regions of road courses. Although these tire barriers offer significant impact attenuation, these systems capture virtually all impacting vehicles, significantly increasing the total velocity change during the crash and greatly increasing the risk of driver injury or fatality. Further, tire barriers can allow vehicles to under-ride the barrier and lead to intrusion into the vehicle's occupant compartment. This type of system is generally appropriate only for locations where vehicle redirection is not practical, such as the gore areas created at tight hairpin turns.

In the late 1990's, a barrier system known as the FLAG barrier was developed. The FLAG barrier was a compression-type barrier consisting of large diameter, thick-walled resilient cylinders attached to a rigid concrete racetrack wall. The cylinders were placed adjacent one another, forming a longitudinal row of cylinders positioned along the track side. Smaller diameter cylinders were placed on the traffic-side face of the longitudinal barrier and positioned and attached at the recessed regions between the larger cylinders to minimize the potential for vehicle pocketing. This barrier system was crash tested using a 1,248 kg vehicle impacting at a speed of 121.0 km/hr and an angle of 20.8 degrees. After compressing several of the cylinders, the test vehicle was smoothly redirected, exiting the system at a speed of 70.0 km/hr and an angle of 15.0 degrees. However, the vehicle's velocity change and exit angle were both relatively high.

In 1998, a polyethylene energy dissipating system (PEDS) was developed for use on oval racetracks. The PEDS barrier system was configured using high-density polyethylene (HDPE) cylinders covered by a thick HDPE skin on the front and top of the cylinders. To expedite construction and repair of the PEDS system, the barrier was designed and fabricated in modular units attached to the concrete wall using a cable restraint system. The cover skin was used to reduce the potential for vehicle pocketing in the front face and reduce or eliminate the potential for the driver's extremities becoming caught in the openings between the cylinders. During the running of an IROC race at the Indianapolis Motor Speedway in August, 1998, driver Arie Luyendyk was involved in a crash which resulted in his IROC car impacting rearward on the PEDS barrier installed downstream from the inside corner of turn four. The estimated impact condition for this event consisted of a 1,633 kg car striking the barrier at a speed of 209 km/hr and an angle of 32 degrees. Remarkably, the driver sustained no serious injury from this severe impact event. These relatively positive results were attributed to the PEDS barrier and the excellent energy management of IROC vehicles during rearward impacts. The PEDS barrier, however, sustained significant damage, and debris was spread across the racing surface. Based on the impact performance of the PEDS barrier, several modifications were made to increase its energy-absorbing capabilities and prevent the units from becoming dislodged.

Beginning in 1999, researchers at the Midwest Roadside Safety Facility (MwRSF) in Lincoln, Nebr. in cooperation with IRL and NASCAR, investigated several energy-absorbing barrier concepts for use in high-speed racetrack and roadway applications using both computer simulation modeling and full-scale vehicle crash testing. The energy-absorbing properties and potential of both HDPE and foam materials were investigated. This testing and simulation indicated that HDPE barrier systems allowed impacting vehicles to gouge into the material and create snagging and pocketing, indicating to the MwRSF researchers that HDPE barrier faces offered no improvements or advantages over concrete barriers.

Simulation and testing of vehicle barriers indicates that lateral accelerations imparted to impacting vehicles and their occupants can be greatly reduced by adding even modest amounts of energy dissipation to rigid barrier systems. Further, testing has indicated that the utilization of relatively stiff longitudinal barrier elements would minimize vehicle rebound from the barrier. Subsequently, an energy-absorbing barrier system utilizing rubber energy absorbers with steel reinforced fiberglass fender panels was developed. This barrier design included a cable and strut mechanism by which the fender panels were attached to the vertical concrete backup structure to allow the barrier to deflect rearward with limited longitudinal motion. However, the relatively short "fish scale" fender panels and the soft energy absorbers utilized in this barrier caused the system to deform around the front of the impacting vehicle, increasing the potential for snagging and/or high rebound angles at increased impact speeds. Further, the cables and struts used to mount the barrier to the backup structure also posed potential snagging problems during high-speed impacts.

SUMMARY OF THE INVENTION

Accordingly, it is an object of the present invention to provide an energy-absorbing vehicle barrier system for use on high-speed race tracks and public roadways.

Another object of the present invention is to provide an energy-absorbing vehicle barrier system that reduces the potentially harmful deceleration forces experienced by an impacting vehicle and its occupants.

It is a further object of the present invention to provide an energy-absorbing vehicle barrier system that reduces or eliminates the potential for vehicle pocketing, gouging, or snagging in either direction of travel.

Yet another object of the present invention is to provide an energy-absorbing vehicle barrier system comprised of readily-available materials and that may be relatively easily and quickly repaired following a damaging vehicle impact.

A further object of the present invention is to provide a single energy-absorbing vehicle barrier configuration suitable for impacts from either open-wheel or stock car vehicles.

The present invention provides for a high-impact, energy-absorbing vehicle barrier system. The barrier system generally includes a substantially rigid outer containment wall coupled via coupling assemblies with an energy-absorbing inner impact wall, and energy-absorbing cartridges positioned between the impact wall and containment wall. A preferred embodiment of the barrier system of the present invention includes an impact wall comprised of a plurality of rectangular or square cross-sectioned structural steel tubes welded to one another to present a substantially smooth, uniform wall to passing vehicles. The impact wall generally consists of a number of impact wall sections coupled with one another by sliding splice units having beveled end faces. The face of the impact wall may be coated with a lubricant, such as zinc-rich paint, to further minimize friction between the impact wall and an errant, impacting vehicle. The energy-absorbing cartridges, which in one embodiment consist of a plurality of foam sheets, compress and crush between the containment wall and impact wall and absorb energy from a vehicle striking the face of the impact wall. The deflection and deformation of the impact wall tubes toward the containment wall further dissipates energy of the impacting vehicle. The barrier system of the present invention is suitable for use on high-speed race tracks and public roadways, significantly reduces peak vehicular decelerations experienced by an impacting vehicle and its occupants, minimizes the potential for vehicle gouging, snagging, or pocketing in either direction of travel, and mitigates the severity of high-energy vehicular impacts. The coupling assemblies and sliding splice units provide for relatively easy and quick removal and replacement of damaged impact wall sections.

The new, high-impact, energy-absorbing barrier system of the present invention was developed to mitigate the severity of high-energy vehicular impacts. In impacts with rigid walls, vehicular decelerations are often maximized as the rigid wall does not displace and substantially all of the impact energy must be dissipated by the vehicle structure (e.g. the vehicle body, engine, transmission, tires, etc.). The new barrier system of the present invention reduces the severity of an impact when a vehicle strikes a containment wall at a high speed. The system reduces or eliminates snagging or pocketing in both directions of vehicle travel and also provides energy dissipation in both the impacting vehicle and the energy-absorbing barrier, significantly reducing peak vehicular and vehicle occupant decelerations when compared to the decelerations observed during an impact with a rigid containment wall. The mitigation of these high vehicular decelerations greatly reduces the potential for serious injury or fatality as a result of the impact with the exterior containment wall.

The barrier system of the present invention is designed primarily for use as protection for errant vehicles at high-risk locations such as on the outside of curves on race tracks and heavily congested high-speed roadways. Since this new barrier is primarily, but not exclusively, a longitudinal barrier, the technology has potential application as a roadside barrier in high accident locations such as curves in tunnels and congested roadways. The technology also has application in retrofitting rigid bridge railings and other permanent or temporary traffic barriers. For longitudinal barrier applications, the system would primarily be intended to mitigate the severity of oblique-angle vehicular impacts. However, this technology may also be applied to severe, high-impact events where perpendicular impacts to the system are anticipated. These higher-severity events include situations where crash cushions, end terminals, and truck-mounted or trailer-mounted attenuators are used. The technology of the present invention also may be used for energy-absorbing docks for tractor-trailers and ships.

Certain embodiments of the present invention were disclosed in U.S. patent application Ser. No. 10/118,728, currently pending in the United States Patent and Trademark Office and incorporated herein by reference.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

Figure 1:
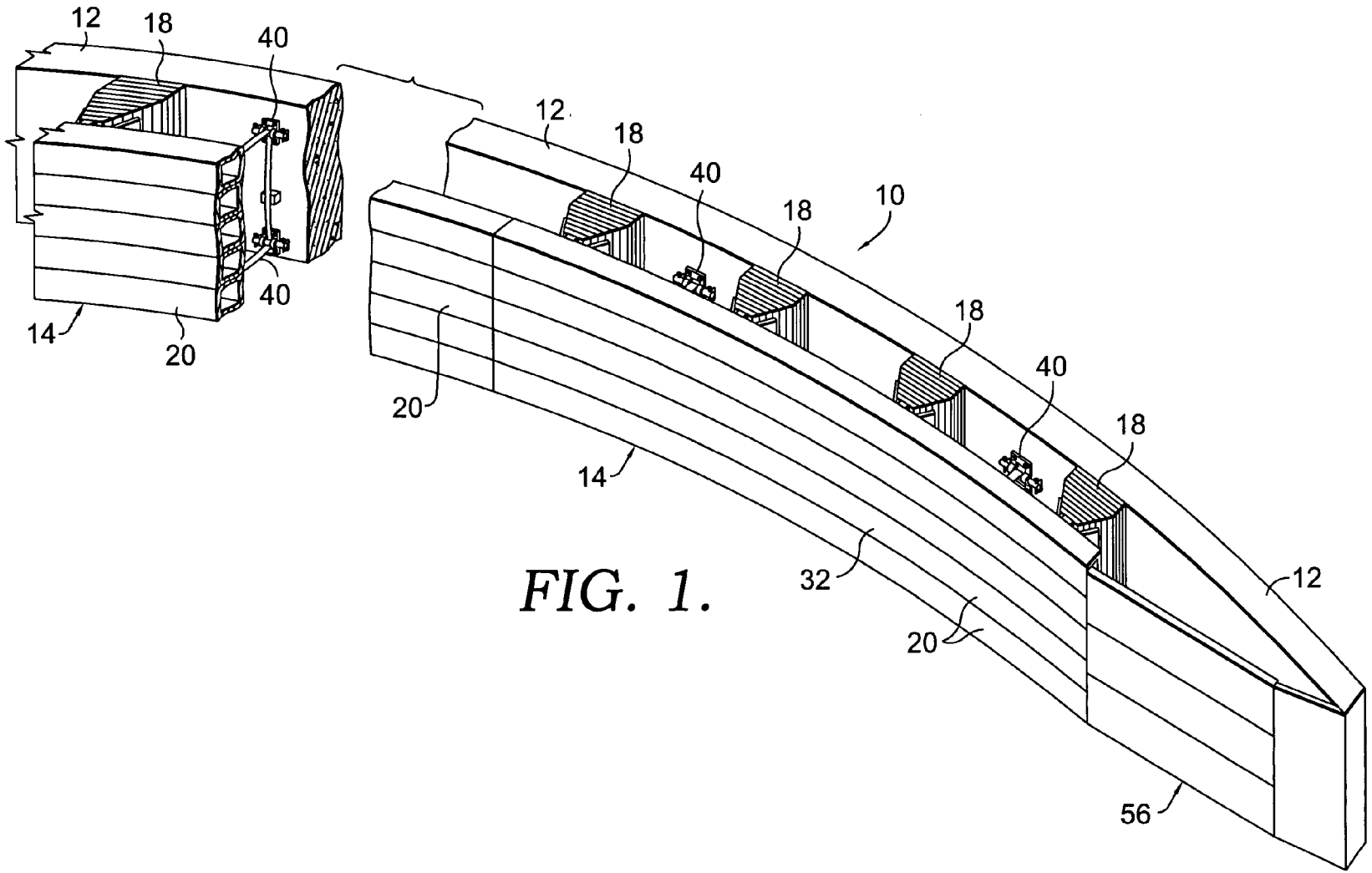
FIG. 1 is a perspective view of an energy-absorbing vehicle barrier system, with parts broken away to show particular details of construction.
Figure 2:
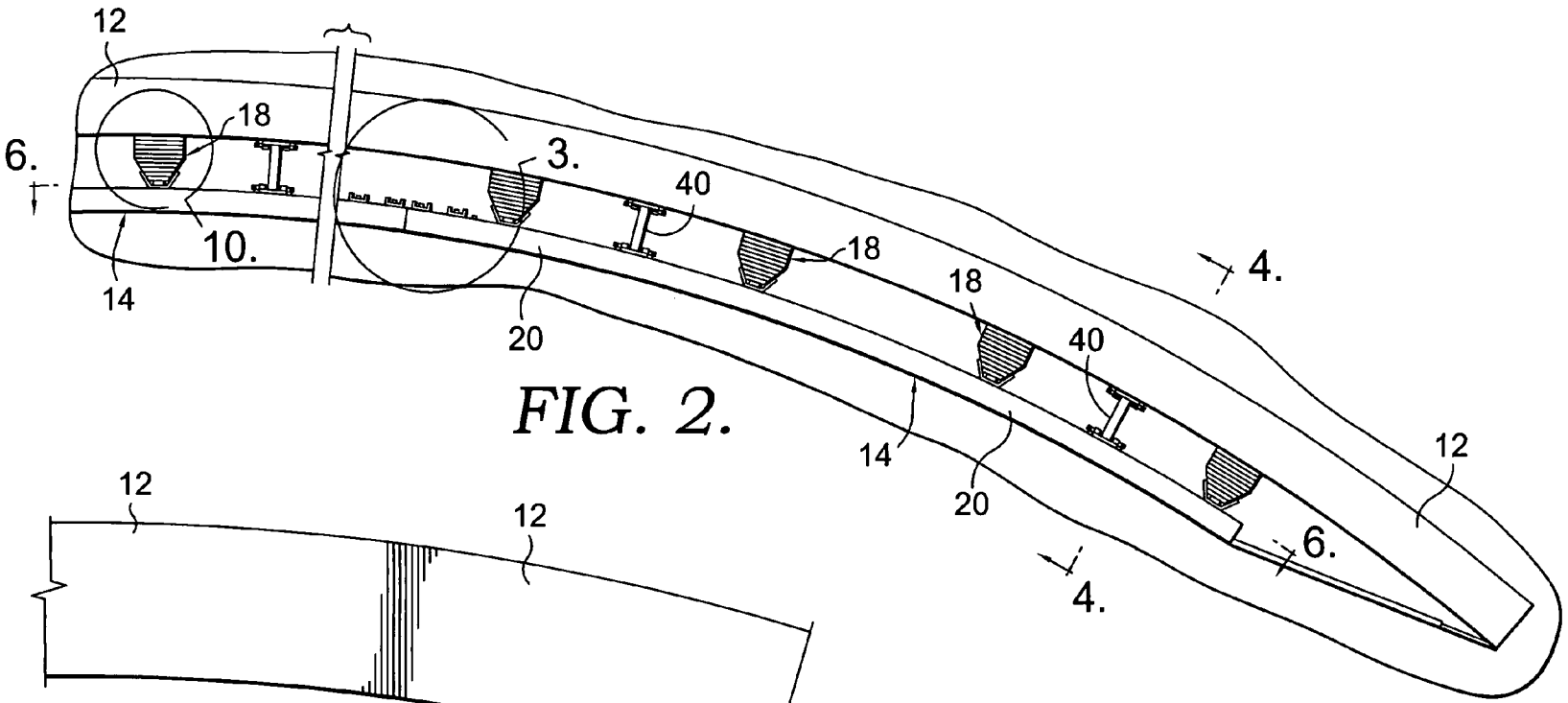
FIG. 2 is a top plan view of the system of FIG. 1.

As seen in FIG. 1, a high-impact, energy-absorbing vehicle barrier system 10 of the present invention generally includes a, substantially rigid containment wall 12, an energy-absorbing impact wall 14, a number of coupling assemblies 16 coupling the containment wall 12 with the impact wall 14, and a number of energy-absorbing cartridges 18 positioned between the containment wall 12 and the impact wall 14. It will be understood that the walls 12 and 14 of the barrier system 10 may be relatively straight (for use adjacent race track straightaways, for example) and/or the walls may be curved for barrier system 10 installations adjacent to race track or roadway turns having a radius, as seen in FIGS. 1 and 2. For example, in one embodiment suitable for installation at racetracks having shorter lengths or smaller/tighter radius corners, the impact wall 14 is configured using pre-curved structural steel tubes 20 rolled to a specified, pre-determined radius and over a particular tube length prior to fabrication. In addition, the tubes 20 may be configured with a tangent length on each end to allow for easier installation of the internal splice units (hereinafter described) and to provide for a more economical design.

The containment wall 12 is generally constructed of heavily reinforced concrete, but may be constructed of stone, fabricated steel, or other substantially rigid material. The impact wall 14 of the present invention is configured such that it can be easily attached to an existing containment wall 12 such as those typically used at race tracks and high-speed tunnels, or an entire barrier system 10, including impact wall 14 and containment wall 12, may be constructed for newly-constructed race tracks and roadways.

Figure 4:
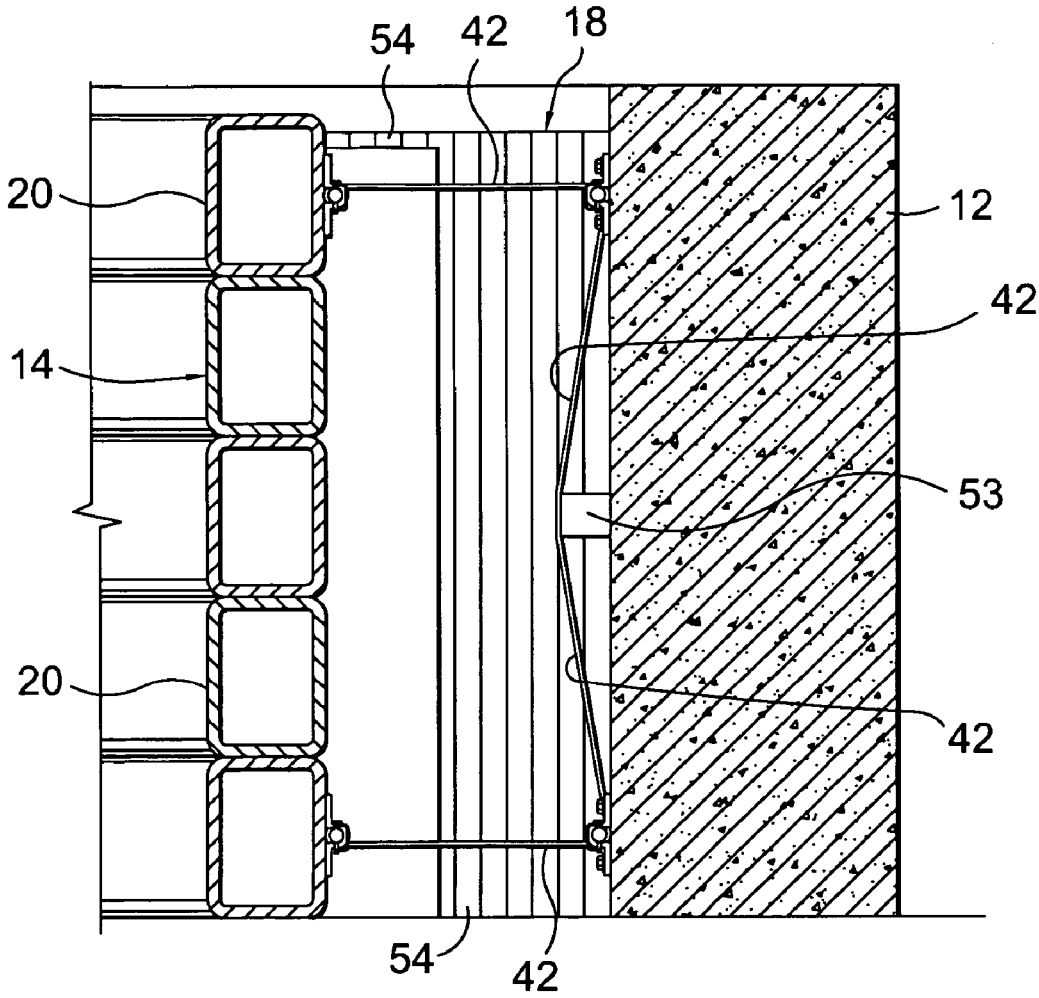
FIG. 4 is a cross-sectional view taken along line 4-4 of FIG. 2.
Figure 6:
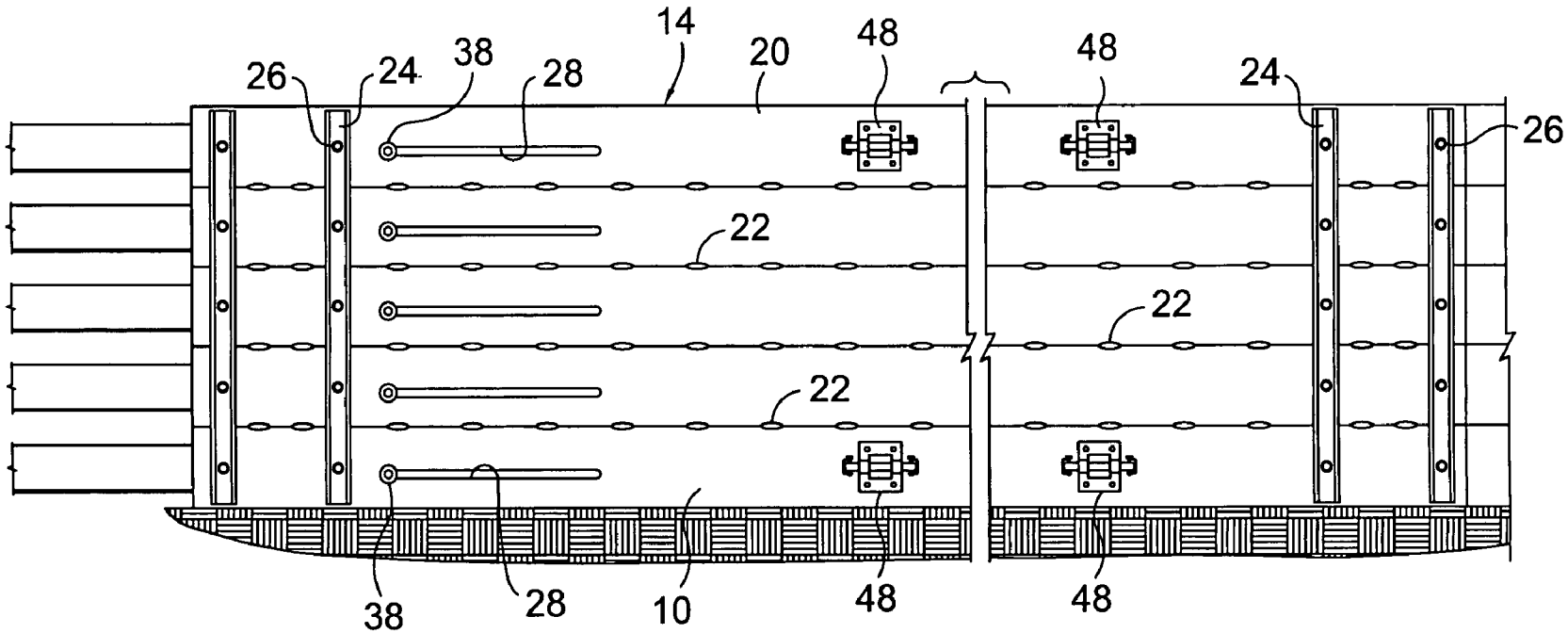
FIG. 6 is a cross-sectional view taken along line 6-6 in FIG. 2.

The impact wall 14 is preferably constructed from a series of structural steel tubes 20, as best seen in FIGS. 1 and 4. The tubes 20 preferably are hollow, have a rectangular or square cross-section, and are constructed of ASTM A500 Grade C steel having a tube wall thickness of 3/16 inches. It will be understood by one skilled in the art that tubes 20 may be constructed of a variety of materials having varying dimensions and wall thicknesses suitable for dissipating energy of an impacting vehicle and resistant to snagging, pocketing, or gouging. The materials and wall thickness are selected based upon the desired energy absorption. The tubes 20 are preferably coupled with one another by a series of stitch or skip welds 22 spaced along the inner face of the tubes 20 (as seen in FIG. 6) and the outer faces of the tubes (not shown) to form impact wall 14 and presenting a substantially uniform, smooth face along the edge of the track or roadway, as seen in FIG. 1. The tubes 20 may also be continuously welded to one another, but stitch or skip welds 22 are preferred, as the energy of an impacting vehicle may, under some impact conditions, be additionally dissipated in a controlled manner as the tube 20 weld 22 interface fractures and gives way under the force of the impacting vehicle. The tubes 20 may be further coupled with one another at their inner faces by brace members 24 extending across the inner faces of the tubes 20 and perpendicular to the long axes of the tubes 20, as seen in FIG. 6. The brace members 24 are preferably constructed of steel channel fixed to the tubes 20 by welding and/or by use of brace bolts 26 that extend through the brace members 24 and into or through bolt holes or apertures formed in the inner walls of the tubes 20.

When welded or otherwise coupled with one another, the tubes 20 form the impact wall 14 and, as seen in FIG. 1, present a relatively smooth, continuous face to impacting vehicles that spreads the vehicle impact forces and the deflection of the wall 14 over a relatively large area. The face of the wall 14 is preferably substantially vertical. This impact wall 14 configuration also minimizes the potential for vehicle capture, gouging, pocketing, or snagging and serves to redirect an impacting vehicle at a relatively low exit angle relative to the wall. The outer, traffic-side face of wall 14 is preferably galvanized or coated with a zinc-rich paint, low-friction lubricant, or other material to further reduce friction between the impact wall 14 and an impacting vehicle, reduce the change in velocity of the impacting vehicle and driver, and reduce the exit angle of the impacting vehicle. The lower surface of impact wall 14 may rest directly on the surface of the race track or roadway as seen in FIG. 6, or may be elevated slightly from the track or roadway surface by use of shims or supports positioned between the lower barrier surface and the surface of the track or roadway to permit water drainage and facilitate removal of debris from between the impact wall 14 and containment wall 12.

The use of structural steel tubes 20 to form the impact wall 14 allows the wall 14 to be manufactured from readily-available structural materials and permits a wide range of barrier height, as measured from the track or roadway surface to the top of the device. In one embodiment designed for use at the Indianapolis Motor Speedway in Indianapolis, Ind. and disclosed in U.S. patent application Ser. No. 10/118,728 (incorporated herein by reference), the impact wall 14 was formed of four (4) structural steel tubes 20 each having a rectangular cross section and a width of six (6) inches, the bottom tube 20 having a height of approximately twelve (12) inches, the two (2) inner tubes 20 each having a height of approximately eight (8) inches, and the upper tube 20 having a height of approximately ten (10) inches, for a total impact wall 14 height of approximately thirty eight (38) inches.

In another embodiment, best seen in FIGS. 1, 4, and 6, the impact wall 14 consists of five (5) equal-size structural steel tubes 20 skip-welded above one another at the seam and with the stiffened seams located at strategically-placed elevations, for a total impact wall height of approximately forty (40) inches. This configuration has stiffened seams at 8 inches, 16 inches, 24 inches, and 32 inches above grade, in lieu of the previously-mentioned four-tube embodiment having seams located at 12 inches, 20 inches, and 28 inches above grade. This embodiment provides improved structural integrity. In addition, it is not uncommon for open-wheel cars to lose control while traveling through a corner, thus resulting in a rearward impact into the impact wall 14 of the present invention. In this embodiment, the reduced individual tube height provides improved vertical positioning of the stiffened tube webs or seams and reduces excessive punching of the vehicle's rigid gear box and transmission into the lowest tube 20 by directing the rearward-impacting vehicle into the second tube 20 above grade. In addition, this configuration provides for a smaller unsupported distance for the front flange of the lower tube 20 (i.e., a reduction from 12 inches to 8 inches and 10 inches to 8 inches for the lowest tube 20 and second tube 20 above grade, respectively) and for a slight increase in moment capacity of the impact wall 14 due to the additional stiffened seams/webs that result from the addition of another tube 20.

It will be understood that the impact wall may be constructed of a single unitary member or tube 20, or may be constructed of any number of tubes 20 or other structural members having varying dimensions and wall thicknesses.

Figure 3:
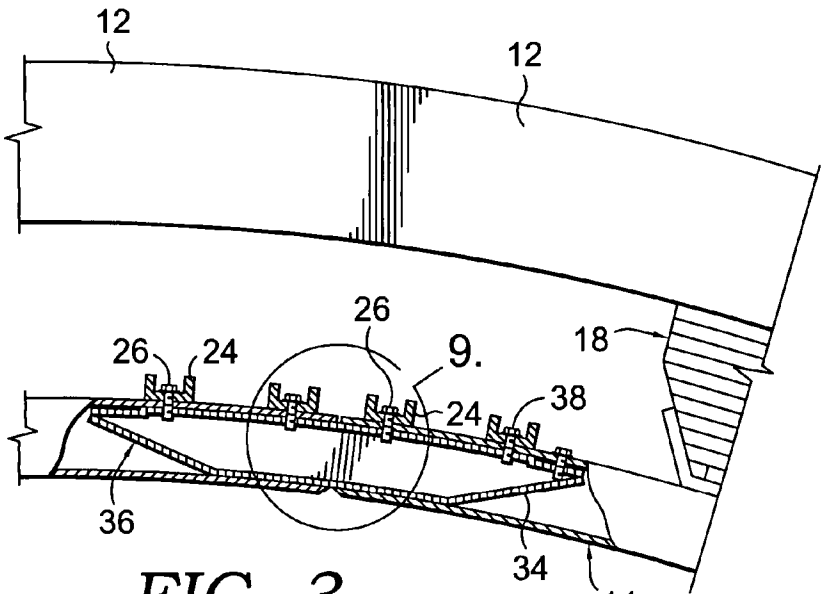
FIG. 3 is an enlarged view of the encircled portion labeled 3 in FIG. 2, with parts broken away to show particular details of construction.

The barrier system 10 of the present invention may include a single section of impact wall 14, or may be formed of a plurality of impact wall sections coupled with one another by splice units 34. In a particular multi-section embodiment such as that depicted in FIG. 1, the preferred length of each impact wall section is twenty (20) feet. In such a multi-section embodiment, internal "hidden" splice units 34 are slidably positioned within the tubes 20 at the joints between adjacent impact wall 14 sections and serve to couple the impact wall 14 sections to one another at the adjoining ends of adjacent sections. In one embodiment, as seen in FIGS. 2 and 3, the splice units 34 have beveled, sloped end faces and are constructed of ASTM A500 Grade C steel. The splice units 34 are coupled with the tubes 20 by one or more threaded brace bolts 26 which extend through an aperture or hole in the brace member 24, through an aperture or hole in the wall of the tube 20, and through an aperture or hole in the wall of the splice unit 34, as seen in FIG. 3. To couple together curved wall sections used at turns or corners having a radius, the splice units 34 may be slightly curved or bent to conform to the face of the wall 14 sections and the walls of the tubes 20. The splice units 34 are typically slidably connected with the tubes 20 by one or more threaded sliding splice bolts 38 fitted with a washer and extending through the tube slot 28 in the inner face of the tube and through an aperture or hole formed in the wall of the splice unit 34, as seen in FIGS. 3 and 6. When the brace bolts 26 and splice bolts 38 are removed or loosened sufficiently, the splice units may slide and telescope within the tubes 20, as will be further discussed below. It will be understood that the sliding splice bolts 38 may be eliminated in some non-longitudinal barrier applications, as in installations having substantially curved walls sections 14 that would not lend themselves to splice units 34 sliding and telescoping within the tubes 20.

Figure 9:
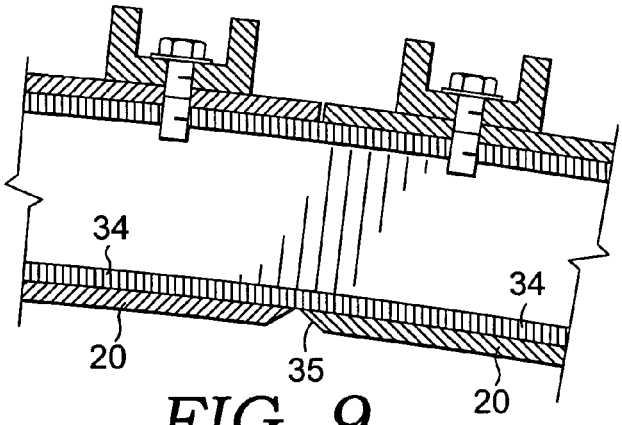
FIG. 9 is an enlarged view of the encircled portion labeled 9 in FIG. 3.

The internal, "hidden" splice units 34 reduce the potential that the sections of impact wall 14 will separate or that the joints between the sections of impact wall 14 will open up when a vehicle impacts the wall 14. The outer edges of the tubes 20 or wall sections may be beveled at the wall 14 or tube 20 ends, such that the joints between sections of the impact wall 14 have a shallow, V-shaped indentation 35, as best seen in FIG. 9. In addition, in the event a vehicle strikes the impact wall 14 at or near a splice unit 34, the beveled end faces 36 of the splice units 34 and the beveled edges of the tubes 20 or walls 14 serve to minimize the potential that an edge or corner of the splice unit 34 will penetrate the wall of a tube and contact or snag the impacting vehicle, or that an impacting vehicle will snag on an impact wall joint. The configuration of the splice units 34 also results in a "bidirectional" joint between sections of impact wall 14, in that the beveled end faces 36 of the splice units 34 also ensure that the face of the impact wall 14 will remain substantially smooth, continuous, and snag- and pocket-free regardless of the direction of travel of the impacting vehicle. Finally, the splice units 34 allow for relatively rapid and easy replacement of impact wall 14 sections when necessary, as will be further discussed below.

The impact wall 14 and containment wall 12 are preferably removably coupled to one another by coupling assemblies. In one embodiment, disclosed in U.S. patent application Ser. No. 10/118,728 and incorporated herein by reference, cable restraint assemblies are positioned along and between the containment wall and the impact wall and serve to removably couple the impact wall with the containment wall. In this embodiment, the cable restraint assemblies are positioned along and between the impact and containment walls at approximately ten (10) foot intervals. The cable restraint assembly generally consists of a cable (preferably ⅜" diameter galvanized wire rope), a ferrule fixed to an end of the cable, and a threaded rod fixed to the other end of the cable. A keyhole plate is positioned over the aperture in the wall of the tube and attached to the wall of the tube as by welding. The keyhole plate has a partially threaded keyhole aperture which receives the ferrule and a keyhole bolt or plug. An internally threaded sleeve is embedded in the containment wall and receives the threaded rod. The containment wall and impact wall are thus removably coupled by placing the ferrule through the aperture and sliding the cable downwardly into position in the aperture. The plug is then threaded into the upper, threaded portion of the aperture. The sleeve is anchored in the containment wall and the rod is threaded into the sleeve. The sleeve and cable may extend through the entire thickness of the containment wall to provide additional cable anchorage strength.

Figure 5:
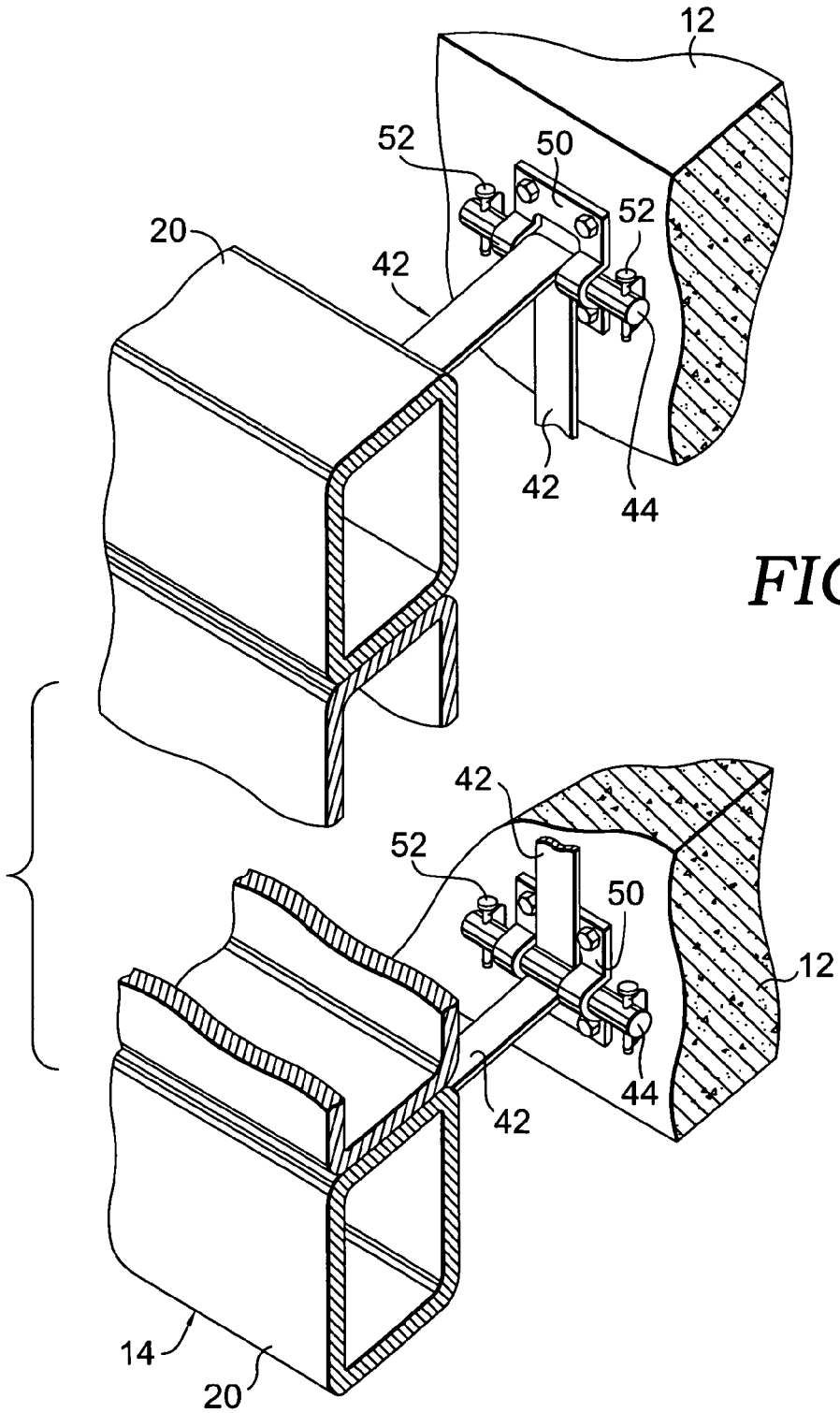
FIG. 5 is an enlarged view of the encircled region labeled 5 in FIG. 1.
Figure 7:
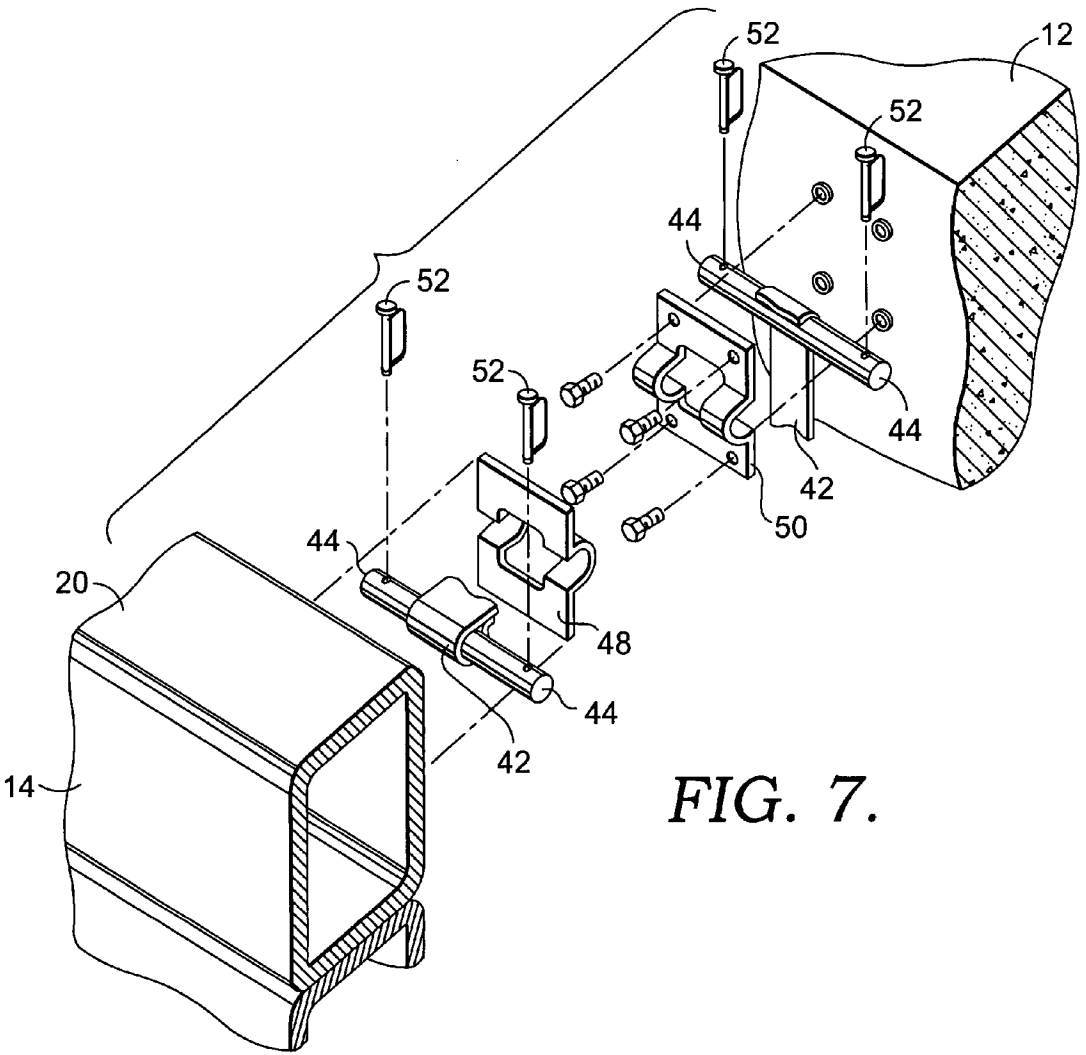
FIG. 7 is a view similar to FIG. 5 with parts exploded.

Another, improved coupling assembly 40 for anchoring the impact wall to the containment wall is depicted in FIGS. 4, 5, and 7 and generally comprises energy-absorbing straps 42, quick-release high-strength corrosion-resistant alloy load pins 44, and steel mounting plates 46 for the strap-to-impact wall 14 and strap-to-containment wall 12 connections in lieu of the cable restraint assemblies previously described. It was observed by the inventors that the aforementioned cable restraint assemblies occasionally encountered failures during high-speed impacts. These failures either resulted from the threaded inserts becoming dislodged from the concrete containment wall or from the partial to complete rupture of the cable itself. These occasional failures occurred when the impact wall 14 rebounded away from the outer containment wall 12 during unloading or as the vehicle was redirected away from the barrier system following a vehicular impact. It was observed that, on occasion, the wire rope/cable attachments did not provide sufficient energy-dissipation capacity to prevent an axial overload of the ropes/cables and threaded anchors.

The improved coupling assembly 40, which incorporates straps 42, provides an improved energy-dissipating, anchorage system wherein the straps 42: (1) are allowed to stretch during unloading and rebound of the vehicle away from the containment wall; (2) provide improved management of the peak loads in the attachment system; and (3) prevent the attachment system from being compromised. Quick-release, high-strength, corrosion-resistant alloy load pins 44 (constructed from 17-4 H1150 stainless steel, for example) are used to transmit the rebound load to the plates 46 coupled with the impact wall 14 and containment wall 12. The load pin 44 diameter and material specifications are chosen to prevent excessive pin deformations during dynamic loading, to allow for easy removal after unloading, if needed, and to withstand extremely corrosive environments near coastal regions as well as in racetrack settings where various vehicular fluids may contact the surrounding barrier hardware.

As seen in FIGS. 4, 5, and 7, an embodiment of the improved coupling assembly 40 includes top and bottom impact wall plates 48 fixed (e.g., by welding) to the interior face of the impact wall 14 and top and bottom containment wall plates 50 fixed (e.g., by bolts extending through slots in the plates) to the face of the containment wall 12. The impact wall plates 48 and containment wall plates 50 include semi-circular-shaped protrusions through which a load pin 44 (as described above) may be inserted, as seen in FIGS. 5 and 7. The load pins 44 include radially-extending apertures near each end of the pin 44 through which a cotter pin 52 may be inserted to retain the load pins 44 in place. The energy-absorbing strap(s) 42, which may be constructed of nylon or other suitable material and may be coated with a ultraviolet light-resistant material, have a loop or eyelet on each end. In one embodiment, a first end of the strap 42 is coupled to the upper impact wall plate 48 by passing a load pin 44 through the strap eyelet and impact wall plate 48 protrusions. As best seen in FIG. 4, the strap 42 is then extended across the void between the impact wall 14 and containment wall 12, looped over the load pin 44 coupled to the upper containment wall plate 50, extended downwards to the lower containment wall plate 50, looped under the load pin 44 coupled to the lower containment wall plate 50, and extended across the void between the containment wall 12 and impact wall 14. The loop or eyelet on the second end of the strap 42 is then coupled to the lower impact wall plate 48 by passing a load pin 44 through the strap 42 eyelet and impact wall plate 48 protrusions. In this way, the impact wall 14 and containment wall 12 are flexibly coupled with one another. The slack in the strap(s) 42, if any, may be adjusted by moving the containment wall plates up or down (via the bolts extending through slots in the plates, not shown) and/or by placing crushable foam adjustment member(s) 53 between the containment wall 12 and the downwardly-extending portion of the strap 42, as seen in FIG. 4.

This improved coupling assembly 40 provides enhanced energy-dissipation characteristics, offers greater structural integrity following a severe impact event, allows for the coupling system 40 to be reused without repair following high-energy impacts into the barrier system 10, and mitigates peak rebound loads by permitting the straps 42 to stretch, but not break, under dynamic loads in tension.

It will be understood that other mechanical coupling systems having threaded, bolted, hooked, or relatively quick-release connection mechanisms known to persons skilled in the art may be used to removably couple the impact wall 14 with the containment wall 12. The coupling assemblies 40 serve to position the impact wall 14 adjacent the containment wall 12, hold the impact wall 14 in an upright, vertical position, prevent the impact wall sections from pulling away from the containment wall 12, and spread the impact load over a greater length of the barrier system 10 by reducing the total amplitude and increasing the period of the bending wave induced in the tubes that comprise the impact wall 14.

Figure 8:
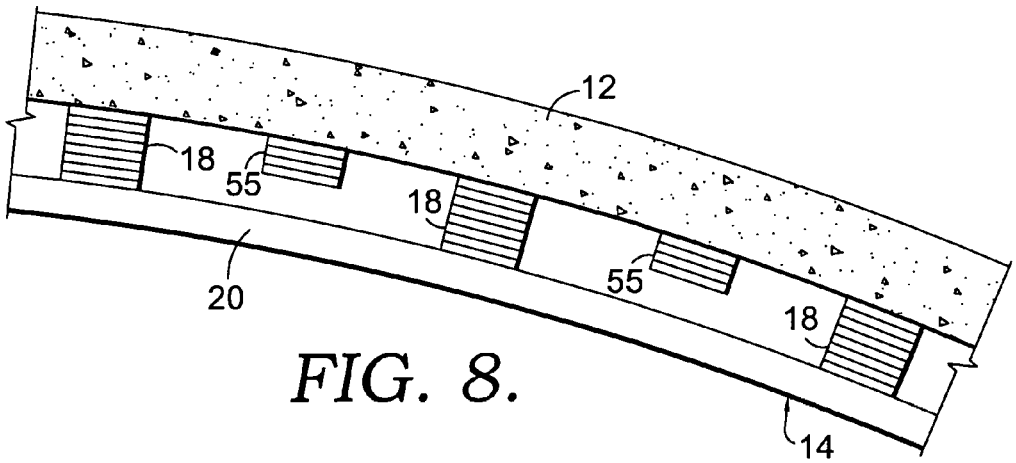
FIG. 8 is a top plan view of a portion of one embodiment of the energy-absorbing vehicle barrier system employing alternating full and half energy-absorbing cartridges.

As seen in FIGS. 1, 2 and 8, energy-absorbing cartridges 18 are positioned between the containment wall 13 and the energy-absorbing impact wall 14. In one embodiment, disclosed in U.S. patent application Ser. No. 10/118,728 and incorporated herein by reference, energy-absorbing cartridges consist of seven (7) DOW or OWENS CORNING extruded polystyrene foam sheets 54, each approximately two (2) inches thick and having a 15 psi stress rating, sandwiched together to form an energy-absorbing cartridge approximately fourteen (14) inches thick and twenty (20) inches in width. The cartridges 18 are held in position between the containment and impact walls by friction between the foam sheets 54 themselves, friction between the outermost foam sheet 54 and the containment wall 12, and friction between the innermost foam sheet 54 and the impact wall 14. The cartridges also fit relatively snugly between the impact and containment walls and the cable or strap is relatively taught, such that no significant gaps exist between the walls and the cartridges sandwiched between them.

Figure 10:
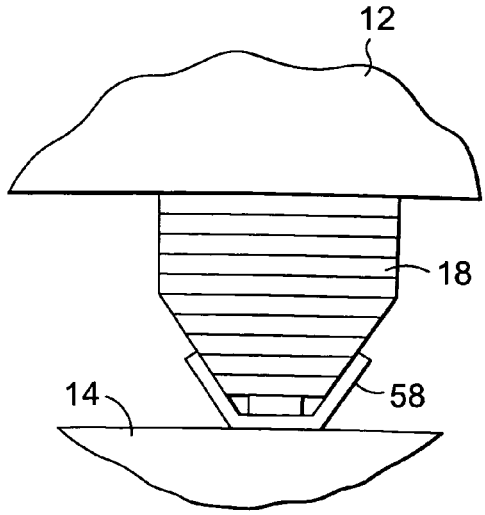
FIG. 10 is an enlarged view of the encircled portion labeled 10 in FIG. 2.

In another embodiment, multi- or variably-staged energy absorbing cartridges 18 are used to allow for one cartridge configuration to be capable of accommodating impacts with both open-wheel and stock car vehicles. In this embodiment, which also may consist of a number of "sandwiched" foam sheets 54 (as previously described), the energy-absorbing cartridge 18 includes a tapered front region adjacent the impact wall 14 that provides reduced impact resistance or energy-absorbing capacity in one end of the cartridge. This tapered cartridge configuration, depicted in FIGS. 1 and 2, allows for an effective energy management system for lighter open-wheel cars (e.g., IRL cars) that compress only a portion of the total available crush distance with the energy-absorbing cartridge. For these lighter cars, a reduced cross-sectional area (and, therefore, crush resistance) is required in the front region of the tapered cartridge 18 in order to maintain acceptable vehicle deceleration levels when considering a lower vehicle mass. Therefore, the first portion of the tapered cartridge 18 must be reasonable narrow and provide only minimal resistance, since the initial inertial forces must be managed as the steel impact wall 14 begins to move upon vehicular contact with lighter cars. As best seen in FIG. 10, cartridge brackets 58 made of tin, steel, plastic, or other suitable material may be coupled with the impact wall 14 by adhesive, welding, screws, bolts, or other means well known to those of skill in the art. The shape of the cartridge brackets 58 generally conforms to the shape of the front region of the cartridges 18, and the cartridge brackets 58 receive the front region of the cartridges 18 to ensure that the cartridges 18 are properly positioned between the impact wall 14 and containment wall 12 and to maintain the cartridges 18 in the proper position between the walls 12 and 14 during an impact to the impact wall 14.

This same tapered cartridge configuration also provides an effective energy-management system for heavier, stock vehicles (e.g., NASCAR series cars) that can compress nearly the entire cartridge in "worst-case" impact scenarios. During severe impacts, these heavier cars will easily crush the front, tapered stage(s) of the cartridge 18 and, subsequently, will crush the rearward stage(s) of the cartridge 18 where safe attenuation occurs. In short, this tapered configuration allows one cartridge configuration and spacing to be used for resisting both open-wheel and stock car vehicle impacts without the need to change cartridge configuration or spacing between races. To accommodate the range of vehicle types and impact conditions, specially-designed blocks, sheets, or cartridges having varying structural and/or physical properties may be employed. For example, the foam blocks, sheets, or cartridges may have voids or hole reductions located in strategic locations. As another example, alternating or staggered types or sizes, of blocks, sheets, or cartridges may be used. Blocks, sheets, or cartridges manufactured from two or more types of materials having varying strength and/or densities also may be used.

Figure 11:
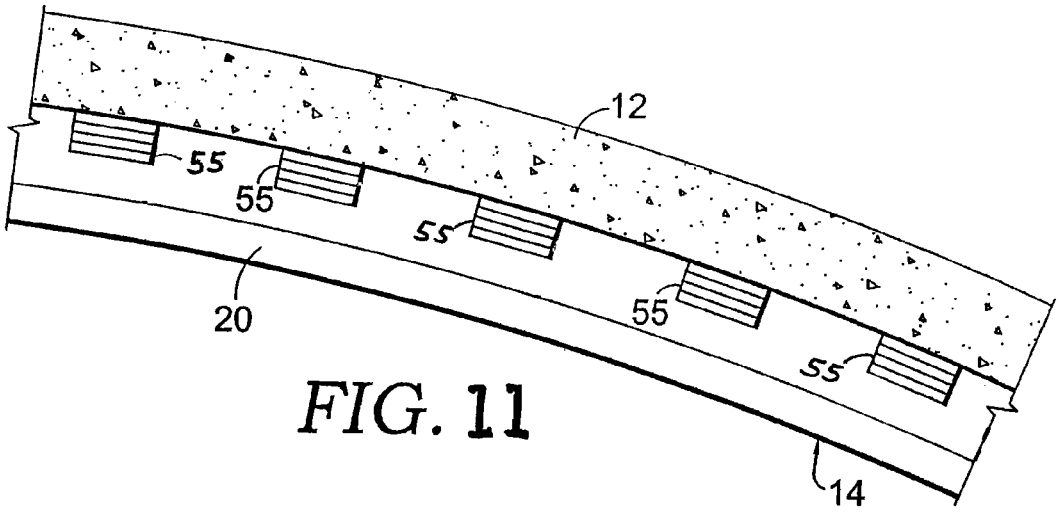
FIG. 11 is a top plan view of an embodiment of the energy-absorbing vehicle barrier system.
Figure 12:
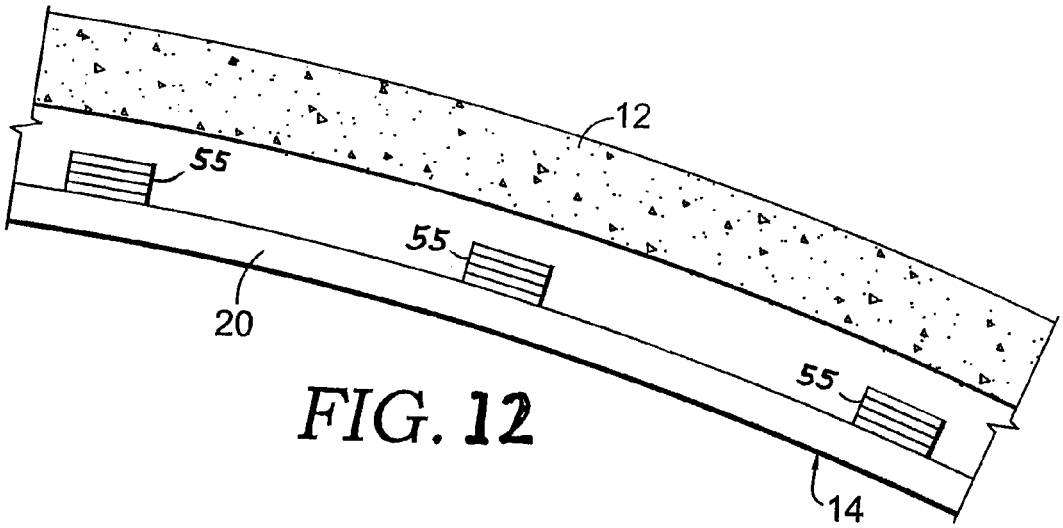
FIG. 12 is a top plan view of an embodiment of the energy-absorbing vehicle barrier system.

Finally, "partial cartridges" or "half cartridges" 55 may be used at certain spaced locations between the impact wall 14 and containment wall 12, as seen in FIGS. 11 and 12. It will be understood that these so-called partial or half cartridges 55 abut either the containment wall 12 (as seen in FIG. 11) or the impact wall 14 (as seen in FIG. 12) but do not extend fully across the void between the impact wall 14 and containment wall 12 and, as such, are subjected to loads or compression only in the event the impact wall 14 is deflected sufficiently toward the containment wall 12 (e.g., during more severe, high-energy impacts) to impinge on and compress the partial or half cartridge 55.

It will be understood that the energy-absorbing cartridges 18 may be constructed of any number of materials and configurations, including polystyrene foam sheets or blocks, expanded bead polystyrene foam, friable polyurethane foam sheets or blocks of varying or constant thicknesses and widths, or rubber or HDPE cylinders or tubes positioned in individual or concentric, telescoping fashion between the impact and containment walls. The energy-absorbing barrier system 10 of the present invention may be "tuned" to accommodate virtually any impact condition by adjusting the cartridge 18 material, thickness, width, height, stress rating, and configuration. It will be understood, for example, that cartridges 18 may consist of a number of sheets or blocks having varying widths so that a cartridge 18 has a substantially tapered, T-shaped, or trapezoidal cross-section as seen from a plan view. The cartridges 18 are relatively easy to remove from and reinstall between the impact and containment walls to enable the user to tune the stiffness and other performance characteristics of the barrier system 10 to match the expected impact conditions for a given site, such as impact speed, vehicle type and weight, and impact angle, and to replace compressed, crushed, cracked, or otherwise damaged cartridges.

In one tested embodiment of the barrier system 10 of the present invention, the energy-absorbing cartridges 18 consisted of seven (7) stacked sheets 54 of OWENS CORNING extruded polystyrene foam having a rating of 15 psi, each sheet 54 having a thickness of two (2) inches, a width of twenty (20) inches, and a height of forty (40) inches. The multi-sheet cartridges were spaced along and between the impact and containment walls at approximately ten (10) foot intervals on center. This embodiment was tested with an Indy open-wheel style vehicle weighing approximately 2,035 lbs striking the face of the impact wall 14 at an approximate speed of 143 m.p.h. and an angle of approximately 20.7 degrees. The vehicle contacted the impact wall at a point approximately ten (10) feet upstream of a joint between impact wall sections and slightly downstream of a cartridge, and exited the impact wall at a velocity vector angle of approximately 4.5 degrees. With this particular tube and cartridge configuration, the tests indicated that the impact wall did not contact or "bottom out" on the containment wall and that the deceleration forces applied to the impacting vehicle and its occupant were substantially mitigated. It will be understood by persons skilled in the art that the barrier system may readily be tuned for specific applications. The number, material, and dimensions of tubes, the spacing of cartridges, and the configuration, thicknesses, and widths of foam sheets all may be adjusted depending upon several factors, including the expected impact angle, impact velocity, and vehicle type(s) (e.g. INDY open-wheel type and/or NASCAR type vehicle, standard car, truck, etc.). In one installed embodiment of the present invention incorporating the tapered cartridge configuration previously described, the cartridge 18 was formed of a number of foam sheets 54 "sandwiched" to a thickness of approximately 22.0 inches, and the cartridges were spaced 1,707 mm (67.2 inches) on center.

The barrier system 10 of the present invention may be continuous and surround the entire periphery of a race track or road way, or the system may be positioned at select locations along the periphery of the track or roadway, at turns or high-speed corners, for example. In the event the barrier system is not continuous, transition sections 56 may be provided at the upstream and/or downstream ends of the impact wall. These transition sections 56, as the name implies, provide a smooth transition from the containment wall 12 to the impact wall 14 and reduce the likelihood of a vehicle impacting and snagging on the blunt end of a section of the impact wall 14. The transition sections 56 may be constructed of tubular members like those of the impact wall, and may be coupled with the adjacent impact wall section by splice units similar to those previously described herein.

In operation, an errant vehicle strikes the face of the impact wall 14. The hollow structural steel tubes 20 which comprise the impact wall 14 deflect towards the containment wall 12, compressing and/or crushing portions or all of the energy-absorbing cartridges 18 between the deflected impact wall 14 and containment wall 12. To ensure that vehicle and driver deceleration forces are minimized, the tubes 20 and cartridges 18 are configured and spaced such that the deflecting impact wall 14 will not contact or "bottom out" on the substantially rigid containment wall 12, as discussed above. The energy of the impacting vehicle is absorbed by the elastic and/or plastic deformation of the tubes 20, the compression and/or crushing of the energy-absorbing cartridges 18, and the crumpling or crushing of portions of the impacting vehicle itself.

In the event of a extremely high-speed impact, a tube or tubes 20, an entire impact wall section, and/or one or more cartridges 18 may become plastically deformed or otherwise damaged such that replacement of a section of impact wall 14 and/or one or more cartridges 18 or portion(s) thereof is desired. The barrier system 10 of the present invention allows for relatively quick and easy repair and replacement of a damaged section of impact wall 14. To replace such a section, the coupling assembly 40 must be uncoupled from the impact wall 14, and the splice units 34 on each end of the section to be replaced must be slidably removed from the tubes 20 of the section to be replaced. To accomplish this, the brace bolts 26 and sliding splice bolts 38 are typically first removed or loosened sufficiently such that the splice units 34 are disengaged from the walls of the tubes 20 and may slide and telescope within the tubes 20. The sliding splice bolts 38 are generally grasped and pulled to the side along the length of the tube slots 28 until the splice units 34 completely clear the joint between the section of impact wall 14 to be replaced and the adjacent section(s). The coupling assembly 40 is then disconnected from the impact wall 14 section to be replaced. The damaged section may then be removed, and a new, undamaged section installed in its place by coupling the new section to the adjacent section(s) via the splice units 34 and by coupling the new section to the containment wall 12 via the coupling assembly(ies) 40. In the event one or more energy-absorbing cartridges 18 are cracked, crushed, plastically deformed, or otherwise damaged, new cartridges 18, or parts thereof, may be readily replaced. This is accomplished by removing the damaged cartridge(s) 18 and positioning the new cartridge(s) 18 between the containment wall and impact wall section before an impact wall section is installed or by simply sliding new cartridge(s) 18 between already-installed and coupled impact and containment walls.

It will be seen from the foregoing that this invention is one well adapted to attain the ends and objects set forth above, and to attain other advantages which are obvious and inherent in the device. It will be understood that certain features and subcombinations are of utility and may be employed without reference to other features and subcombinations. It will be appreciated by persons skilled in the art that the present invention is not limited to what has been particularly described above. Rather, all matter described above is to be interpreted as illustrative and not limiting.

We claim:

1. An energy-absorbing vehicle barrier system, comprising:

a substantially rigid outer containment wall;

an inner, energy-absorbing impact wall spaced from said containment wall, said impact wall comprising a plurality of impact wall sections in end-to-end, abutting relation, each of said impact wall sections comprising a plurality of tubes coupled with one another, said impact wall having an interior face facing said containment wall and a vehicle-side exterior face, said exterior face having a radius of curvature and presenting a substantially smooth, uniform surface;

a coupling assembly adapted to removably couple said impact wall to said containment wall; and at least one energy-absorbing cartridge positioned between said impact wall and said containment wall.

2. The system of claim 1, wherein each of said impact wall sections comprises five (5) tubes coupled with one another.

3. The system of claim 2, wherein each of said tubes is approximately eight (8) inches in height and wherein the overall height of said impact wall is approximately forty (40) inches.

4. The system of claim 1, wherein said coupling assembly comprises a strap assembly removably coupled between said impact wall and said containment wall.

5. The system of claim 4, wherein said strap assembly comprises a strap having a first end and a second end, said strap assembly further comprising means for removably attaching said first end of said strap to said impact wall and means for removably attaching said second end of said strap to said containment wall.

6. The system of claim 1, wherein said energy-absorbing cartridge comprises at least one foam member.

7. The system of claim 1, wherein said energy-absorbing cartridge comprises a tapered region adjacent said impact wall.

8. The system of claim 1, wherein said energy-absorbing cartridge comprises a plurality of foam members.

9. The system of claim 8, wherein the width of said foam member adjacent said containment wall is greater than the width of said foam member adjacent said impact wall.

10. The system of claim 8, wherein the cross-sectional area of said foam member adjacent said containment wall is greater than the cross-sectional area of said foam member adjacent said impact wall.

11. The system of claim 1, wherein a plurality of said energy-absorbing cartridges are positioned between said impact wall and said containment wall in spaced relation with one another.

12. The system of claim 1, wherein said energy-absorbing cartridge defines a plurality of voids.

13. The system of claim 1, wherein said energy-absorbing cartridge abuts said containment wall and is spaced from said impact wall.

14. The system of claim 1, wherein said energy-absorbing cartridge abuts said impact wall and is spaced from said containment wall.

15. The system of claim 1, further comprising at least one splice unit coupled between adjacent said wall sections.

16. The system of claim 15, wherein said splice unit is a member slidably engaged with corresponding said impact wall sections.

17. The system of claim 15, wherein said splice unit has a pair of beveled ends, said ends received in adjacent said impact wall sections.

18. The system of claim 1, wherein said tubes are hollow structural steel members having a substantially rectangular cross section.

19. The system of claim 1, wherein said tubes are constructed of ASTM A500 Grade C steel.

20. The system of claim 1, wherein said tubes are coupled with one another by discontinuous welds.

21. The system of claim 1, wherein said exterior face of said impact wall is coated with a substantially smooth, friction-resistant material.

* * * * *